US009070364B2

(12) United States Patent
Oh et al.

(10) Patent No.: US 9,070,364 B2
(45) Date of Patent: Jun. 30, 2015

(54) METHOD AND APPARATUS FOR PROCESSING AUDIO SIGNALS

(75) Inventors: Hyen-O Oh, Seoul (KR); Chang Heon Lee, Seoul (KR); Jeongook Song, Seoul (KR); Yang Won Jung, Seoul (KR); Hong Goo Kang, Seoul (KR)

(73) Assignees: LG Electronics Inc., Seoul (KR); Industry-Academic Cooperation Foundation, Yonsei University, Seoul (KR)

( * ) Notice: Subject to any disclaimer, the term of this patent is extended or adjusted under 35 U.S.C. 154(b) by 843 days.

(21) Appl. No.: 12/994,425

(22) PCT Filed: May 25, 2009

(86) PCT No.: PCT/KR2009/002743

§ 371 (c)(1),
(2), (4) Date: Nov. 23, 2010

(87) PCT Pub. No.: WO2009/142464

PCT Pub. Date: Nov. 26, 2009

(65) Prior Publication Data

US 2011/0153335 A1 Jun. 23, 2011

Related U.S. Application Data

(60) Provisional application No. 61/055,465, filed on May 23, 2008, provisional application No. 61/078,774, filed on Jul. 8, 2008.

(30) Foreign Application Priority Data

May 21, 2009 (KR) ..... 10-2009-00044623

(51) Int. Cl.
*G10L 21/00* (2013.01)
*G10L 19/08* (2013.01)

(52) U.S. Cl.
CPC ..... *G10L 19/08* (2013.01)

(58) Field of Classification Search
CPC . G10L 19/04; G10L 21/0208; G10L 21/0232; G10L 21/038; G10L 19/0204; G10L 19/087; G10L 19/167; G10L 15/20; G10L 13/047; G10L 13/07; G10L 15/065; G10L 19/02; G10L 19/07; G10L 19/09; G10L 19/005; G10L 19/0212; G10L 19/20; G10L 19/022; G10L 19/03
USPC ..... 704/500–504, 230, 228, 208, 207, 704/E19.001, E19.035, E19.003, 258, 262, 704/219–226, E19.024, E19.026
See application file for complete search history.

(56) References Cited

U.S. PATENT DOCUMENTS 5,233,660 A * 8/1993 Chen ..... 704/208
5,668,927 A * 9/1997 Chan et al. ..... 704/240

(Continued)

FOREIGN PATENT DOCUMENTS

JP 1-180121 A 7/1989
JP 8-328595 A 12/1996

*Primary Examiner* — Abdelali Serrou
(74) *Attorney, Agent, or Firm* — Birch, Stewart, Kolasch & Birch, LLP

(57) ABSTRACT

An audio signal processing method is disclosed. The audio signal processing method includes receiving a residual and long term prediction information, performing inverse frequency mapping with respect to the residual to generate a synthesized residual, and performing long term synthesis based on the synthesized residual and the long term prediction information to generate a synthesized audio signal of a current frame, wherein the long term prediction information comprises a final prediction gain and a final pitch lag, the final pitch lag has a range starting with 0, and the long term synthesis is performed based on a synthesized audio signal of a frame comprising a preceding frame.

7 Claims, 12 Drawing Sheets

(56) References Cited

U.S. PATENT DOCUMENTS

| | | | | |
|---|---|---|---|---|
| 5,673,364 | A * | 9/1997 | Bialik | 704/501 |
| 5,717,827 | A * | 2/1998 | Narayan | 704/260 |
| 5,774,837 | A * | 6/1998 | Yeldener et al. | 704/208 |
| 5,819,212 | A * | 10/1998 | Matsumoto et al. | 704/219 |
| 5,864,797 | A | 1/1999 | Fujimoto | |
| 5,890,108 | A * | 3/1999 | Yeldener | 704/208 |
| 6,134,518 | A * | 10/2000 | Cohen et al. | 704/201 |
| 6,173,257 | B1 * | 1/2001 | Gao | 704/220 |
| 6,188,980 | B1 * | 2/2001 | Thyssen | 704/230 |
| 6,233,549 | B1 * | 5/2001 | Mauro et al. | 704/207 |
| 6,240,386 | B1 * | 5/2001 | Thyssen et al. | 704/220 |
| 6,243,672 | B1 * | 6/2001 | Iijima et al. | 704/207 |
| 6,260,010 | B1 * | 7/2001 | Gao et al. | 704/230 |
| 6,345,247 | B1 * | 2/2002 | Yasunaga et al. | 704/219 |
| 6,385,573 | B1 * | 5/2002 | Gao et al. | 704/220 |
| 6,449,590 | B1 * | 9/2002 | Gao | 704/219 |
| 6,480,822 | B2 * | 11/2002 | Thyssen | 704/220 |
| 6,493,665 | B1 * | 12/2002 | Su et al. | 704/230 |
| 6,507,814 | B1 * | 1/2003 | Gao | 704/220 |
| 6,584,438 | B1 * | 6/2003 | Manjunath et al. | 704/228 |
| 6,604,070 | B1 * | 8/2003 | Gao et al. | 704/222 |
| 6,604,071 | B1 * | 8/2003 | Cox et al. | 704/225 |
| 6,678,649 | B2 * | 1/2004 | Manjunath | 704/207 |
| 6,694,291 | B2 * | 2/2004 | Mauro et al. | 704/205 |
| 6,745,155 | B1 * | 6/2004 | Andringa et al. | 702/189 |
| 6,813,602 | B2 * | 11/2004 | Thyssen | 704/222 |
| 6,823,303 | B1 * | 11/2004 | Su et al. | 704/220 |
| 6,829,579 | B2 * | 12/2004 | Jabri et al. | 704/221 |
| 6,931,373 | B1 * | 8/2005 | Bhaskar et al. | 704/230 |
| 7,013,269 | B1 * | 3/2006 | Bhaskar et al. | 704/219 |
| 7,143,032 | B2 * | 11/2006 | Chen | 704/228 |
| 7,289,951 | B1 * | 10/2007 | Ojanperaa | 704/207 |
| 8,239,192 | B2 * | 8/2012 | Kovesi et al. | 704/219 |
| 2001/0023395 | A1 * | 9/2001 | Su et al. | 704/220 |
| 2002/0138256 | A1 * | 9/2002 | Thyssen | 704/220 |
| 2003/0097258 | A1 * | 5/2003 | Thyssen | 704/222 |
| 2004/0010407 | A1 * | 1/2004 | Kovesi et al. | 704/219 |
| 2004/0093208 | A1 * | 5/2004 | Yin | 704/230 |
| 2004/0260542 | A1 * | 12/2004 | Ananthapadmanabhan et al. | 704/219 |
| 2005/0071153 | A1 * | 3/2005 | Tammi et al. | 704/219 |
| 2006/0143002 | A1 * | 6/2006 | Ojanpera | 704/207 |
| 2006/0173677 | A1 | 8/2006 | Sato et al. | |
| 2007/0124139 | A1 * | 5/2007 | Chen | 704/219 |
| 2008/0046248 | A1 * | 2/2008 | Chen et al. | 704/262 |

* cited by examiner $$\hat{S}_{t(n)} = \hat{r}_{t(n)} + b0 \cdot \hat{S}_{t(n-d0)}$$

(A)

(B)

METHOD AND APPARATUS FOR PROCESSING AUDIO SIGNALS

This application is the National Phase of PCT/KR2009/002743 filed on May 25, 2009, which claims priority under 35 U.S.C. to 119(e) to U.S. Provisional Application Nos. 61/055,465 filed on May 23, 2008 and 61/078,774 filed on Jul. 8, 2008 and under 35 U.S.C. 119(a) to Patent Application No. 10-2009-0044623 filed in the Republic of Korea on May 21, 2009, the entire contents of which are hereby expressly incorporated by reference into the present application.

BACKGROUND OF THE INVENTION

1. Field of the Invention

The present invention relates to an audio signal processing method and apparatus that encode or decode an audio signal.

2. Discussion of the Related Art

In general, short term prediction, such as linear prediction coding (LPC), is performed on a time domain so as to compress a speech signal. Subsequently, a pitch is acquired with respect to a residual resulting from the short term prediction so as to perform long term prediction.

When long term prediction is performed with respect to a residual resulting from linear prediction coding, compressibility of a signal containing a speech component is high, but compressibility of a signal containing a non-speech component is low.

SUMMARY OF THE INVENTION

Accordingly, the present invention is directed to an audio signal processing method and apparatus that substantially obviate one or more problems due to limitations and disadvantages of the related art.

An object of the present invention is to provide an audio signal processing method and apparatus that are capable of performing long term prediction with respect to an audio signal containing a speech component and a non-speech component in a mixed state.

Another object of the present invention is to provide an audio signal processing method and apparatus that are capable of performing long term prediction with respect to an audio signal and coding a residual on a frequency domain.

Another object of the present invention is to provide an audio signal processing method and apparatus that are capable of obtaining prediction the most similar to a current frame using a preceding frame, i.e., a frame right before the current frame.

Another object of the present invention is to provide an audio signal processing method and apparatus that are capable of generating long term prediction information necessary for a decoder to perform long term synthesis using obtainable information (for example, a synthesized residual), not unobtainable information (for example, a source signal).

A further object of the present invention is to provide an audio signal processing method and apparatus that are capable of temporarily generating long term prediction information through long term prediction using a source signal and deciding final long term prediction information through long term synthesis in the vicinity thereof.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an audio signal processing method includes receiving a residual and long term prediction information, performing inverse frequency transforming with respect to the residual to generate a synthesized residual, and performing long term synthesis based on the synthesized residual and the long term prediction information to generate a synthesized audio signal of a current frame, wherein the long term prediction information comprises a final prediction gain and a final pitch lag, the final pitch lag has a range starting with 0, and the long term synthesis is performed based on a synthesized audio signal of a frame comprising a preceding frame.

In another aspect of the present invention, an audio signal processing apparatus includes an inverse transforming unit for performing inverse frequency transforming with respect to a residual to generate a synthesized residual and a long term synthesis unit for performing long term synthesis based on the synthesized residual and long term prediction information to generate a synthesized audio signal of a current frame, wherein the long term prediction information comprises a final prediction gain and a final pitch lag, the final pitch lag has a range starting with 0, and the long term synthesis is performed based on a synthesized audio signal of a frame comprising a preceding frame.

In another aspect of the present invention, an audio signal processing method includes performing long term prediction on a time domain using a source audio signal of a preceding frame to generate a temporary residual of a current frame, frequency transforming the temporary residual, inversely frequency transforming the temporary residual to generate a synthesized residual of the preceding frame, and deciding long term prediction information using the synthesized residual.

The step of deciding the long term prediction information may include performing long term synthesis using the synthesized residual to generate a synthesized audio signal of the preceding frame and deciding the long term prediction information using the synthesized audio signal.

The step of generating the temporary residual may include generating a temporary prediction gain and a temporary pitch lag, and the long term synthesis may be performed based on the temporary prediction gain and the temporary pitch lag.

The long term synthesis may be performed using one or more candidate prediction gains based on the temporary prediction gain and one or more candidate pitch lags based on the temporary pitch lag.

The long term prediction information may include a final prediction gain and a final pitch lag, and the long term prediction information may be decided based on the source audio signal.

In another aspect of the present invention, an audio signal processing apparatus includes a long term prediction unit for performing long term prediction on a time domain using a source audio signal of a preceding frame to generate a temporary residual of a current frame, a frequency transforming unit for frequency transforming the temporary residual, an inverse transforming unit for inversely frequency transforming the temporary residual to generate a synthesized residual of the preceding frame, and a prediction information decision unit for deciding long term prediction information using the synthesized residual.

The audio signal processing apparatus may further include a long term synthesis unit for performing long term synthesis using the synthesized residual to generate a synthesized audio signal of the preceding frame, wherein the prediction information decision unit may decide the long term prediction information using the synthesized audio signal.

The long term prediction unit may generate a temporary prediction gain and a temporary pitch lag, and the long term synthesis may be performed based on the temporary prediction gain and the temporary pitch lag.

The long term synthesis may be performed using one or more candidate prediction gains based on the temporary prediction gain and one or more candidate pitch lags based on the temporary pitch lag.

The long term prediction information may include a final prediction gain and a final pitch lag, and the long term prediction information may be decided based on the source audio signal.

In a further aspect of the present invention, there is provided a storage medium for storing digital audio data, the storage medium being configured to be read by a computer, wherein the digital audio data include long term flag information, a residual, and long term prediction information, the long term flag information indicates whether long term prediction has been applied to the digital audio data, the long term prediction information includes a final prediction gain and a final pitch lag generated through long term prediction and long term synthesis, and the final pitch lag has a range starting with 0.

The present invention has the following effects and advantages.

First, it is possible to perform long term prediction with respect to a speech signal and an audio signal containing a speech component and a non-speech component in a mixed state, thereby improving coding efficiency with respect to a signal that is repetitive, in particular, on a time domain.

Second, it is possible to refer to a preceding frame, i.e., a frame right before a current frame, so as to search prediction of the current frame, thereby obtaining the most similar prediction and thus reducing a bit rate of a residual.

Third, it is possible to perform long term synthesis through a decoder using obtainable information (for example, a quantized residual), not unobtainable information (for example, a source signal), thereby increasing a restoring rate of long term synthesis.

Fourth, it is possible to approximate long term prediction information (pitch lag and prediction gain) through relatively noncomplex processing and to more accurately decide prediction information within a searching range reduced based thereon, thereby reducing overall complexity.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
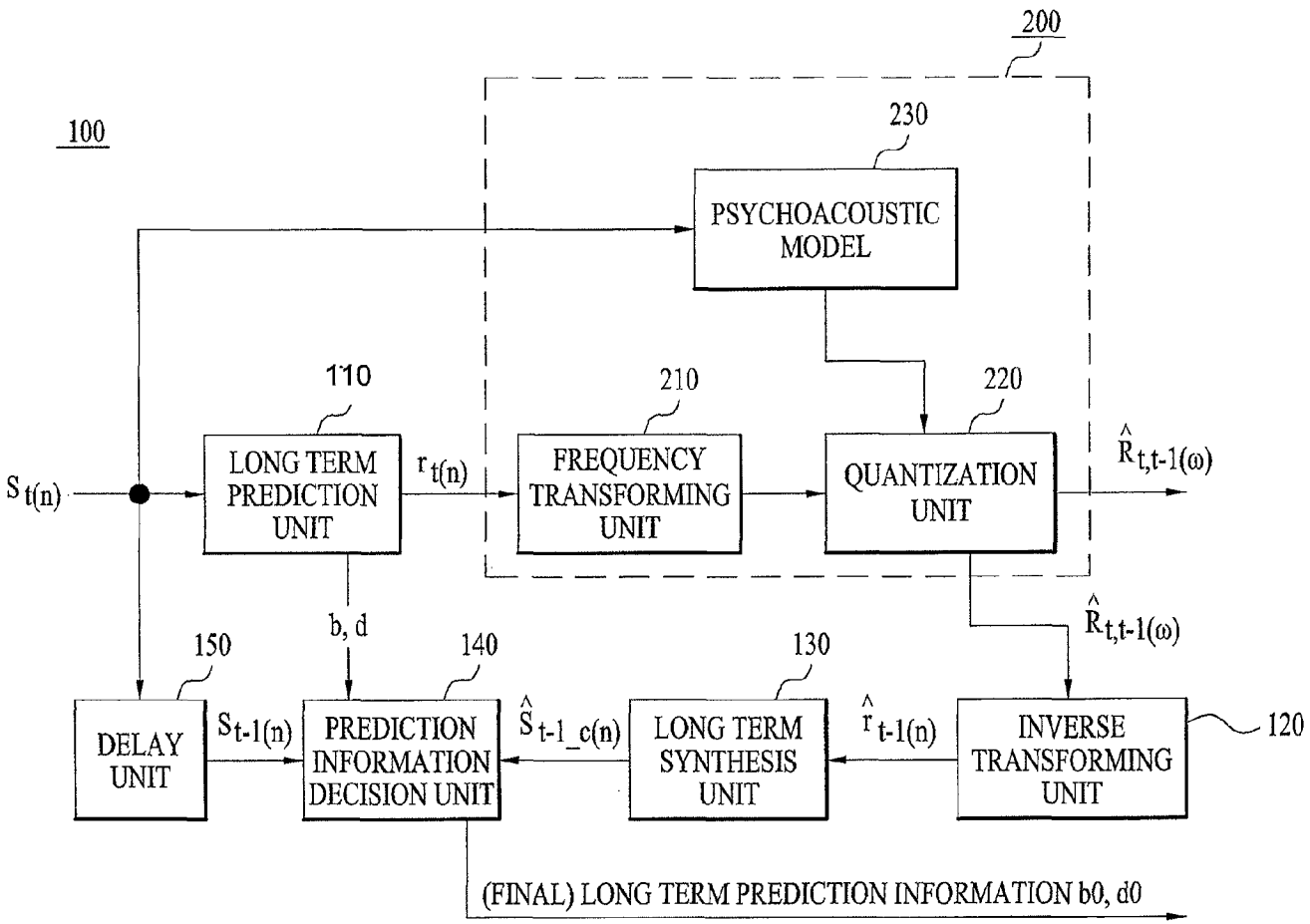
FIG. 1 is a construction view illustrating a long term encoding device of an audio signal processing apparatus according to an embodiment of the present invention.

Reference will now be made in detail to the preferred embodiments of the present invention, examples of which are illustrated in the accompanying drawings. First of all, terminology used in this specification and claims must not be construed as limited to the general or dictionary meanings thereof and should be interpreted as having meanings and concepts matching the technical idea of the present invention based on the principle that an inventor is able to appropriately define the concepts of the terminologies to describe the invention in the best way possible. The embodiment disclosed herein and configurations shown in the accompanying drawings are only one preferred embodiment and do not represent the full technical scope of the present invention. Therefore, it is to be understood that the present invention covers the modifications and variations of this invention provided they come within the scope of the appended claims and their equivalents when this application was filed.

According to the present invention, terminology used in this specification can be construed as the following meanings and concepts matching the technical idea of the present invention. Specifically, 'coding' can be construed as 'encoding' or 'decoding' selectively and 'information' as used herein includes values, parameters, coefficients, elements and the like, and meaning thereof can be construed as different occasionally, by which the present invention is not limited.

In this disclosure, in a broad sense, an audio signal is conceptionally discriminated from a video signal and designates all kinds of signals that can be perceived by a human. In a narrow sense, the audio signal means a signal having none or small quantity of speech characteristics. "Audio signal" as used herein should be construed in a broad sense. Yet, the audio signal of the present invention can be understood as an audio signal in a narrow sense in case of being used as discriminated from a speech signal.

Meanwhile, a frame indicates a unit used to encode or decode an audio signal, and is not limited in terms of sampling rate or time.

An audio signal processing method according to the present invention may be a long term encoding/decoding method, and an audio signal processing apparatus according to the present invention may be a the long term coding (encoding and/or decoding) device encoding/decoding apparatus. In addition, the audio signal processing method according to the present invention may be an audio signal encoding/decoding method to which the long term encoding/decoding method is applied, and the audio signal processing apparatus according to the present invention may be an audio signal encoding/decoding apparatus to which the long term encoding/decoding apparatus is applied. Hereinafter, a long term encoding/decoding apparatus will be described, and a long term encoding/decoding method performed by the long term encoding/decoding apparatus will be described. Subsequently, an audio signal encoding/decoding apparatus and method, to which the long term encoding/decoding apparatus and method are applied, will be described.

Figure 2:
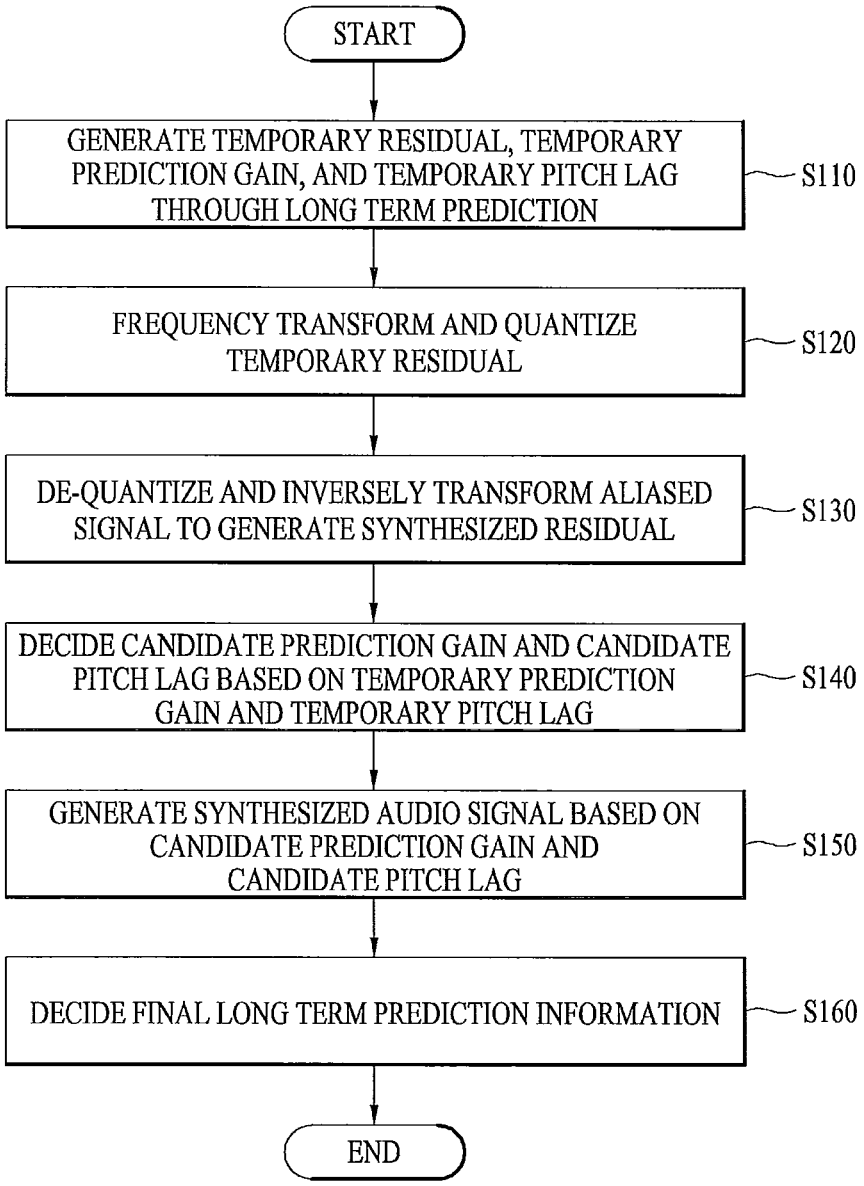
FIG. 2 is a flow chart illustrating an audio signal processing method according to an embodiment of the present invention.

FIG. 1 is a construction view illustrating a long term encoding device of an audio signal processing apparatus according to an embodiment of the present invention, and FIG. 2 is a flow chart illustrating an audio signal processing method according to an embodiment of the present invention. An audio signal processing process of the long term encoding device will be described in detail with reference to FIGS. 1 and 2.

Referring first to FIG. 1, a long term encoding device 100 includes a long term prediction unit 110, an inverse transforming unit 120, a long term synthesis unit 130, a prediction information decision unit 140, and a delay unit 150. The long term encoding device 100 may further include a frequency transforming unit 210, a quantization unit 220, and a psychoacoustic model 230. Here, the long term prediction unit 110 adopts an open loop scheme, and the long term synthesis unit 130 adopts a closed loop scheme. Meanwhile, the frequency transforming unit 210, the quantization unit 220, and the psychoacoustic model 230 may be based on an advanced audio coding (AAC) standard, to which, however, the present invention is not limited.

Figure 3:
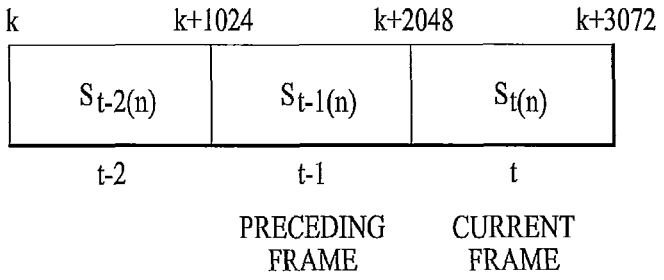
FIG. 3 is a view illustrating a concept of a source signal per frame.

Referring to FIGS. 1 and 2, the long term prediction unit 110 performs long term prediction with respect to a source audio signal St(n) to generate a temporary prediction gain b and a temporary pitch lag d and to generate a temporary residual rt(n) (Step S110). Hereinafter, this step will be described. First, a signal per frame will be described with reference to FIG. 3. Referring to FIG. 3, a current frame t, a preceding frame t−1, which is before the current frame, and a frame t−2 before the preceding frame are present. Audio signals St(n), St−1(n), and St−2(n) are present in the respective frames. One frame may include approximately 1024 samples. If the (t−2)-th frame includes a (k+1)-th sample to a (k+1024)-th sample, the (t−1)-th frame may include a (k+1025)-th sample to a (k+2048)-th sample, and the t-th frame includes a (k+2049)-th sample to a (k+3072)-th sample.

Meanwhile, at Step S110, long term prediction is approximate to the multiplication of a signal preceding a signal at a given point of time n by a pitch lag and a prediction gain, which may be defined as represented by the following mathematical expression.

$$rt(n)=St(n)-b\cdot St(n-d) \quad \text{[Mathematical expression 1]}$$

Where, St(n) indicates a signal of the current frame, b indicates a prediction gain, d indicates a pitch lag, and rt(n) indicates a residual.

Since the prediction gain b and the pitch lag d at Step S110 are not final but are updated at a subsequent step, the prediction gain and the pitch lag at Step S110 may be referred to as a temporary prediction gain and a temporary pitch lag. On the other hand, a temporary residual rt(n) is not recalculated as a final prediction gain and a final pitch lag. However, a transformed (aliased) residual may be generated through frequency transforming, or a synthesized residual may be generated through long term synthesis.

At Step S110, a source signal, not a synthesized signal, is used so as to acquire a prediction similar to the current frame, and therefore, the preceding frame t−1 may be included in a search range of the prediction. This is because it is possible to use a source signal of the preceding frame t−1 without change. Also, Step S110 may be referred to as an open loop scheme or long term prediction.

Meanwhile, the following table shows an example of a mean square error (MSE), a pitch lag, a prediction gain, an output, and a search range when an open loop is performed.

TABLE 1

| | Open loop $\tilde{s}(n) = bs(n-d)$ |
|---|---|
| MSE | $\varepsilon_o = \sum_{n=0}^{N-1} [s(n) - \tilde{s}(n)]^2$ |
| Pitch lag | $d_o = \underset{d}{\operatorname{argmax}} \frac{\sum_{i=0}^{N-1} s(i)s(i-d)}{\sqrt{\sum_{i=0}^{N-1} s(i-d)^2}}$ |
| Prediction gain | $b_o = \frac{\sum_{i=0}^{N-1} s(i)s(i-d_o)}{\sum_{i=0}^{N-1} s(i-d_o)^2}$ |
| output | $r(n) = s(n) - b_o s(n-d_o)$ |
| Search range | $50 \le d_o \le 512$<br>93.75 Hz ~ 960 Hz |

The temporary prediction gain may be generated using the scheme indicated in Table 1, and the temporary pitch lag may be generated using the scheme indicated in Table 1. Also, Mathematical expression 1 is equal to the output indicated in Table 1.

Figure 4:
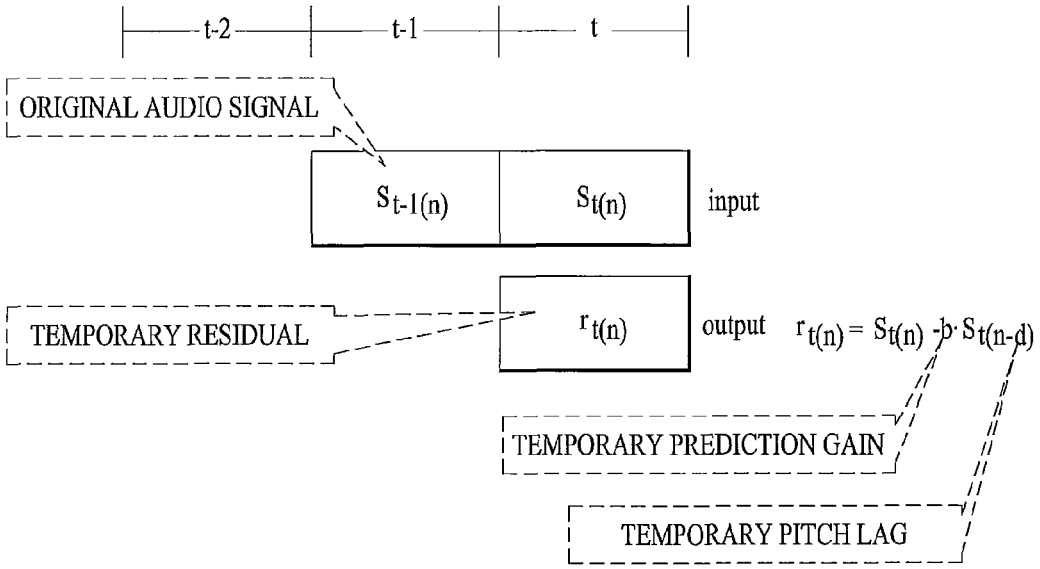
FIG. 4 is a view illustrating a long term prediction process (S110)

Hereinafter, Step S110 will be described in terms of a buffer. Referring to FIG. 4, a source signal St(n) of the current frame and a source signal St−1(n) of the preceding frame are present in an input buffer. A signal the most similar to the source signal St(n) of the current frame may be present in source signal St−1(n) of the preceding frame. At this time, when a temporary prediction gain is b and a temporary pitch lag is d, a temporary residual rt(n) is generated as represented by Mathematical expression 1 and stored in an output buffer.

Referring back to FIGS. 1 and 2, the frequency transforming unit 210 performs time to frequency transforming (or simply frequency transforming) with respect to the temporary residual rt(n) to generate frequency transformed residual signals $\hat{R}_{t-1,t-2}(\omega)$ and $\hat{R}_{t,t-1}(\omega)$ (S120). The time to frequency transforming may be performed based on quadrature mirror filterbank (QMF) or modified discrete Fourier transform (MDCT), to which, however, the present invention is not limited. At this time, a spectral coefficient may be an MDCT coefficient acquired through MDCT. Here, the frequency transformed signals are not perfect with respect to a specific frame and thus may be referred to as aliased signals.

Figure 5:
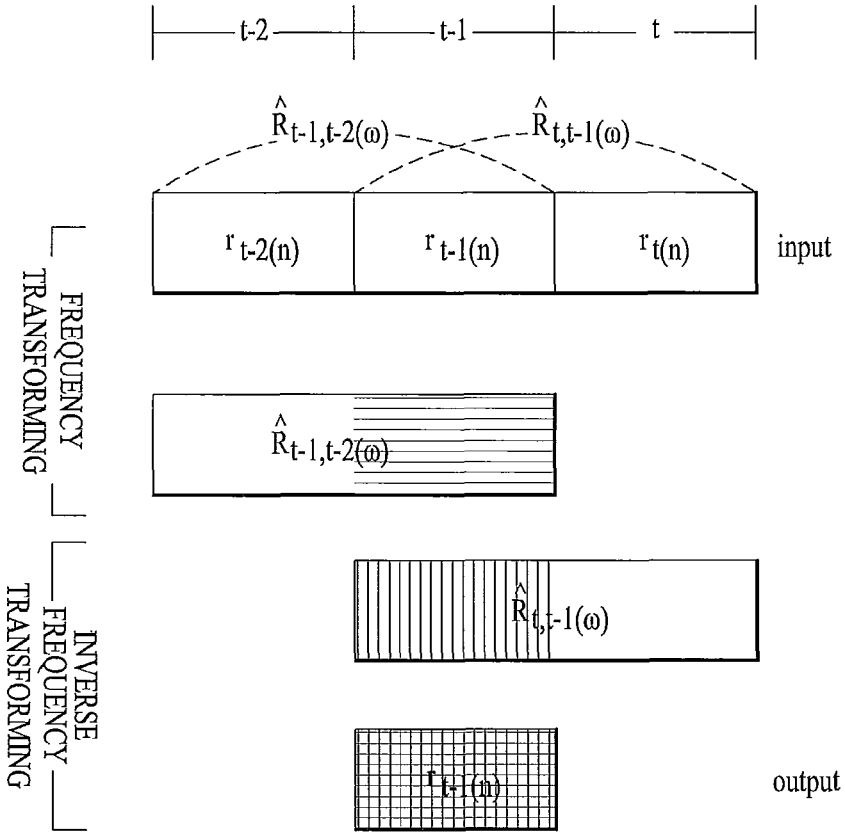
FIG. 5 is a view illustrating a frequency transforming process (S120) and an inverse frequency transforming process (S130)

Hereinafter, Step S120 and Step S130 will be described in terms of a buffer. Referring to FIG. 5, a residual rt−2(n) of the (t−2)-th frame, a residual rt−1(n) of the (t−1)-th frame, and residual rt(n) of the t-th frame are present in an input buffer. A window is applied to the residuals of the two consecutive frames so as to perform frequency transforming. Specifically, a window is applied to the residual of the (t−2)-th frame and the residual of the (t−1)-th frame to generate a transformed residual signal $\hat{R}t-1,t-2(\omega)$, and a window is applied to the residual of the (t−1)-th frame and the residual of the t-th frame to generate a transformed residual signal $\hat{R}t,t-1(\omega)$. These transformed residual signals are input to the inverse transforming unit 120 and inversely frequency transformed at Step S140, resulting in a residual $\hat{r}t-1(n)$ of the (t−1)-th frame, which will be described in detail later.

Meanwhile, the psychoacoustic model 230 applies a masking effect to the input audio signal to generate a masking threshold. The masking effect is based on psychoacoustic theory. Auditory masking is explained by psychoacoustic theory. The masking effect uses properties of the psychoacoustic theory in that low volume signals adjacent to high volume signals are overwhelmed by the high volume signals, thereby preventing a listener from hearing the low volume signals.

The quantization unit 220 quantizes the frequency transformed residual signal based on the masking threshold (S120). The quantized residual signal $\hat{R}t,t-1(\omega)$ may be input to the inverse transforming unit 120 or may be an output of the long term encoding device. In the latter case, the quantized residual signal may be transmitted to a long term decoding device through a bit stream.

The inverse transforming unit 120 performs de-quantization and inverse frequency transforming (or frequency to time transforming) with respect to the frequency transformed residual to generate a synthesized residual $\hat{r}t-1(n)$ of the preceding frame (S130). Here, the frequency to time transforming may be performed based on inverse quadrature mirror filterbank (IQMF) or inverse modified discrete Fourier transform (IMDCT), to which, however, the present invention is not limited.

Referring back to FIG. 5, two frequency transformed signals $\hat{R}t-1,t-2(\omega)$ and $\hat{R}t,t-1(\omega)$ are generated as a result of frequency transforming. These two signals overlap at the (t−1)-th frame, i.e., the preceding frame. These two signals are inversely transformed and then added to generate a synthesized residual signal $\hat{r}t-1(n)$ of the preceding frame. The residual signal of the current frame is generated at the long term prediction step (S110), whereas the synthesized residual $\hat{r}t-1(n)$ with respect to the preceding frame, not the current frame, is generated after the frequency transforming and the inverse transforming.

The long term synthesis unit 130 decides a candidate prediction gain bc and a candidate pitch lag dc based on the temporary prediction gain b and the temporary pitch lag d generated by the long term prediction unit 110 (S140). For example, the candidate prediction gain and the candidate pitch lag may be decided within a range defined as represented by the following mathematical expression.

$$bc=b\pm\alpha$$

$$dc=d\pm\beta \qquad \text{[Mathematical expression 2]}$$

Where, α and β indicate arbitrary constants.

The candidate prediction gain is a group consisting of one or more prediction gains, and the candidate pitch lag is a group consisting of one or more pitch lags. The search range is reduced based on the temporary prediction gain and the temporary pitch lag.

Figure 6:
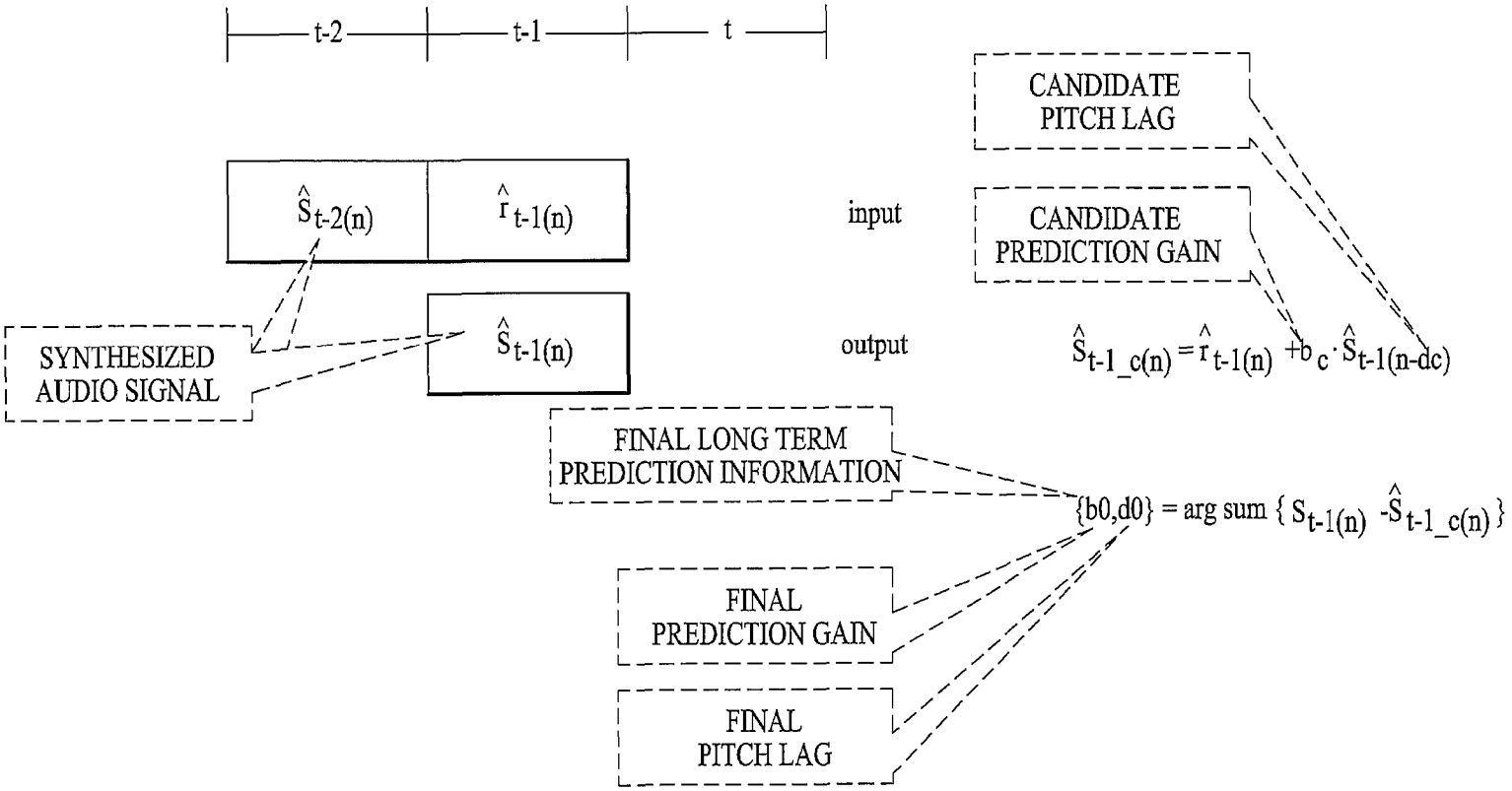
FIG. 6 is a view illustrating a long term synthesis process (S150) and a prediction information decision process (S160)

The long term synthesis unit 130 performs long term synthesis based on the candidate prediction gain bc and the candidate pitch lag dc decided at Step S140 and the residual $\hat{r}t-1(n)$ of the preceding frame generated at Step S130 to generate a synthesized audio signal $\hat{S}t-1(n)$ of the preceding frame (S150). FIG. 6 is a view illustrating a long term synthesis process (S150) and a prediction information decision process (S160). Referring to FIG. 6, a synthesized audio signal of the (t−2)-th frame and a synthesized residual signal of the (t−1)-th frame generated at Step S130 are present in an input buffer. A synthesized audio signal with respect to the candidate prediction gain bc and the candidate pitch lag dc is generated using these two signals as represented by the following mathematical expression.

$$\hat{S}t-1_c(n)=\hat{r}t-1(n)+bc\cdot\hat{S}t-1(n-dc) \qquad \text{[Mathematical expression 3]}$$

Where, $\hat{S}t-1_c(n)$ indicates a synthesized audio signal of the preceding frame with respect to the candidate prediction gain and the candidate pitch lag, $\hat{r}t-1(n)$ indicates a synthesized residual of the preceding frame, and $\hat{S}t-1(n)$ indicates a synthesized audio signal of the preceding frame.

Meanwhile, the following table shows an example of a mean square error (MSE), a pitch lag, a prediction gain, an output, and a search range when a closed loop is performed.

TABLE 2

| | Closed loop $\hat{s}(n) = \hat{r}(n) + b\hat{s}(n-d)$ |
|---|---|
| MSE | $\varepsilon_c = \sum_{n=0}^{N-1} [(s(n) - \hat{r}(n)) - b\hat{s}(n-d)]^2$ |
| Pitch lag | $d_o - C \le d_c \le d_o + C$ <br> $d_c = \underset{d}{\operatorname{argmin}}\{\varepsilon_c\}$ |
| Prediction gain | $s'(n) = s(n) - \hat{r}(n)$ <br> $b_c = \frac{\sum_{i=0}^{N-1} s'(i)s'(i-d_c)}{\sum_{i=0}^{N-1} s'(i-d_c)^2}$ |
| output | $\hat{s}(n) = \hat{r}(n) + b_c\hat{s}(n-d_c)$ |
| Search range | $d_o - C \le d_c \le d_o + C$ <br> C = 10 (samples) |

Also, Mathematical expression 4 may be equal to the output indicated in Table 2. Meanwhile, the search range is not decided as indicated in Table 2. The search range is decided according to the candidate prediction gain and the candidate pitch lag based on the temporary prediction gain and the temporary pitch lag at Step S110.

Meanwhile, the delay unit 150 delays a source signal St(n) with respect to the current frame to input a source signal St−1(n) of the preceding frame to the prediction information decision unit 140 upon processing the next frame.

The prediction information decision unit 140 compares the source signal St−1(n) of the preceding frame received from the delay unit 150 with the synthesized audio signal $\hat{S}t-1_c(n)$ of the preceding frame generated at Step S150 to decide the most appropriate long term prediction information, i.e., the final prediction gain b0 and the final pitch lag d0 (S160).

At this time, final prediction gain and the final pitch lag may be decided as represented by the following mathematical expression.

$$\{bo, do\} = \arg\text{sum}\ \{St-1(n)-\hat{S}t-1_c(n)\} \quad \text{[Mathematical expression 4]}$$

Where, St−1(n) indicates a source signal of the preceding frame, Ŝt−1_c (n) indicates a synthesized audio signal of the preceding frame with respect to the candidate prediction gain and the candidate pitch lag, b0 indicates a final prediction gain, and d0 indicates a final pitch lag.

Mathematical expression 4 may be based on the mean square error (MSE) indicated in Table 2.

The final prediction gain and the final pitch lag generated at Step S160 result from searching of a signal the most similar to the current frame in frames including the (t−1)-th frame (i.e., the preceding frame) based on information that can be acquired by the decoder. Since the final pitch lag results from searching of a signal the most similar to the current frame in frames including the preceding frame in addition to the (t−1)-th frame, a final pitch lag range starts with 0, not N (frame length). If the final pitch lag range starts with N, only the remaining values excluding N can be transmitted. On the other hand, if the final pitch lag range starts with 0, all of the values can be transmitted.

Meanwhile, the prediction information decision unit may further generate long term flag information, which indicates whether long term prediction(or synthesis) has been applied, in addition to the final prediction gain and the final pitch lag.

Figure 7:
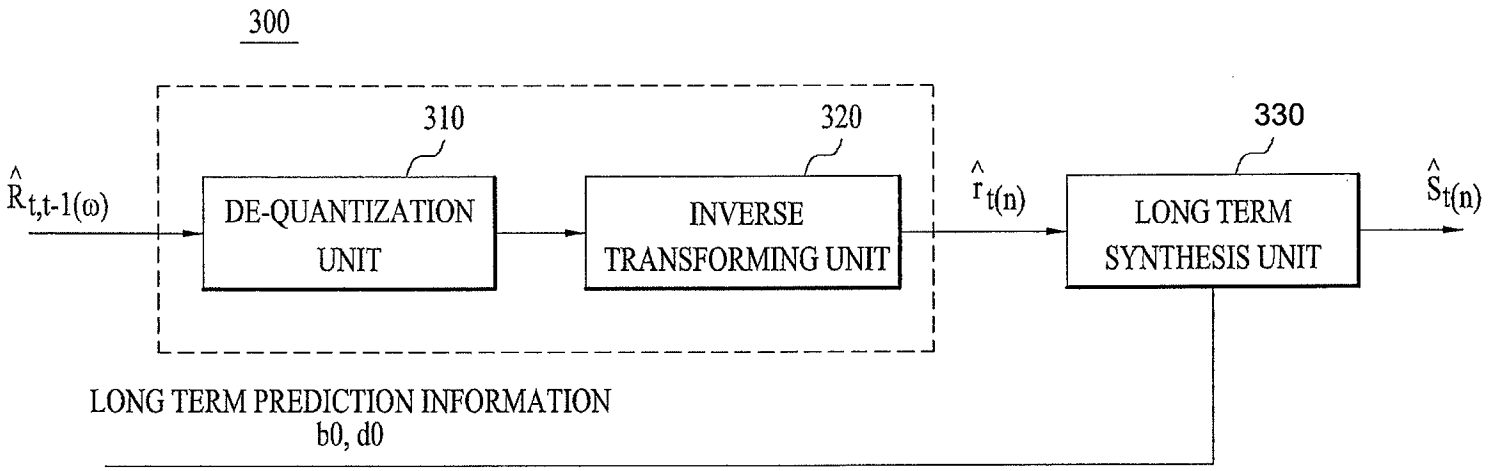
FIG. 7 is a construction view illustrating a long term decoding device of the audio signal processing apparatus according to the embodiment of the present invention.

FIG. 7 is a construction view illustrating a long term decoding device of the audio signal processing apparatus according to the embodiment of the present invention. Referring to FIG. 7, a long term decoding device 300 includes a long term synthesis unit 330. Also, the long term decoding device 300 may further include a de-quantization unit 310 and an inverse transforming unit 320. Meanwhile, the de-quantization unit 310 and the inverse transforming unit 320 may be based on an AAC standard, to which, however, the present invention is not limited.

First, the de-quantization unit 310 extracts a residual R̂t,t−1(ω) from a bit stream and de-quantizes the extracted residual R̂t,t−1(ω). Here, the residual may be a frequency transformed residual or an aliased residual as previously described.

Subsequently, the inverse transforming unit 320 performs inverse frequency transforming (or frequency to time transforming) with respect to the frequency transformed residual R̂t,t−1(ω) to generate a residual r̂t(n) of the current frame. Here, the frequency to time transforming may be performed based on inverse quadrature mirror interbank (IQMF) or inverse modified discrete Fourier transform (IMDCT), to which, however, the present invention is not limited.

Figure 8:
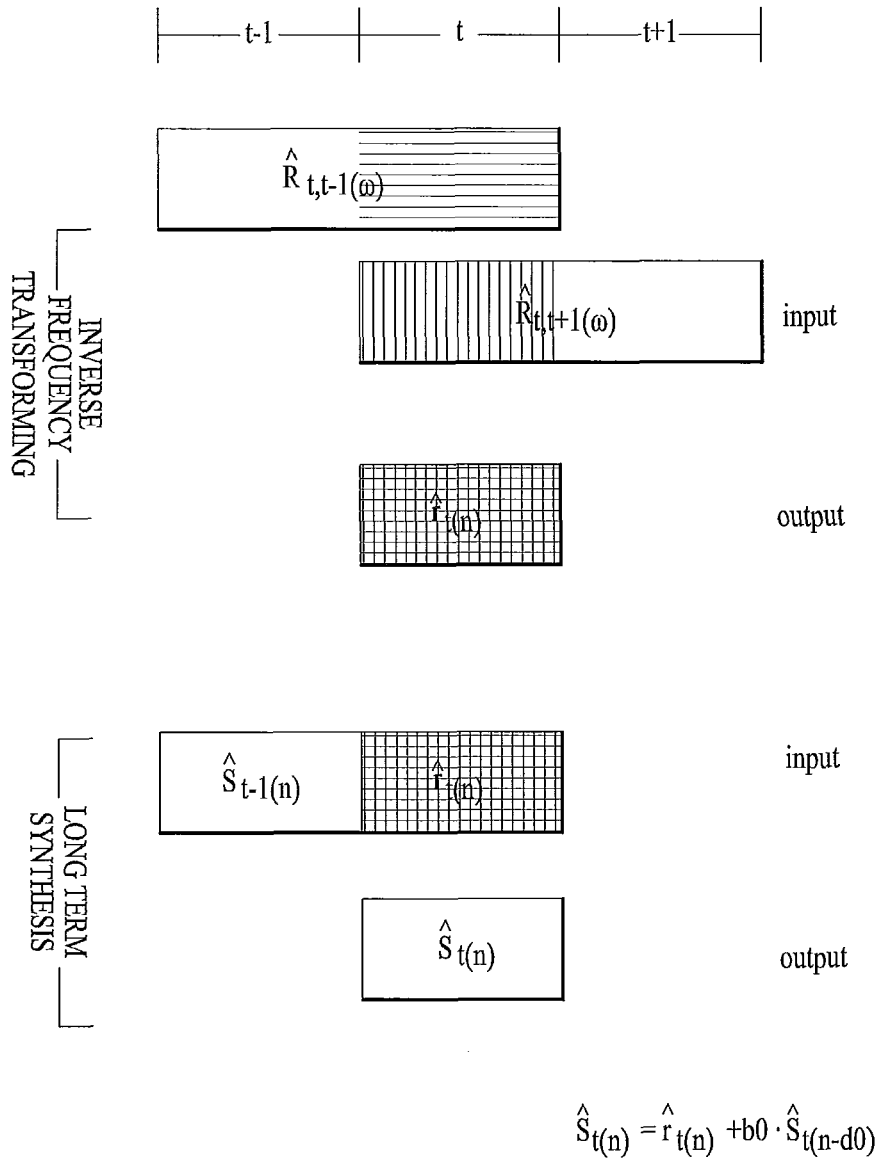
FIG. 8 is a view illustrating a de-quantization process and a long term synthesis process of the long term decoding device.

The acquired residual r̂t(n) may be the synthesized residual r̂t(n) generated by the long term encoding device based on the aliased residuals. A de-quantization process and a long term synthesis process of the long term decoding device are shown in FIG. 8. Referring to FIG. 8, a residual R̂t,t−1(ω) with respect to the (t−1)-th frame and the t-th frame and a residual R̂t,t+1(ω) with respect to the t-th frame and the (t+1)-th frame are present in an input buffer. Meanwhile, a (synthesized) residual r̂t(n) generated through inverse frequency transforming of the signals present in the input buffer is present in an output buffer.

Referring back to FIG. 7, the long term synthesis unit 330 receives long term flag information indicating whether long term prediction has been applied and decides whether long term synthesis is to be performed based thereon. The long term synthesis is performed using the residual r̂t(n) and long term prediction information b0 and d0 to generate a synthesized audio signal Ŝt(n) of the current frame. Here, the long term synthesis may be performed as represented by the following mathematical expression.

$$\hat{S}t(n) = \hat{r}t(n) + b0 \cdot \hat{S}t(n-d0) \quad \text{[Mathematical expression 6]}$$

Where, r̂t(n) indicates a (synthesized) residual, b0 indicates a final prediction gain, d0 indicates a final pitch lag, and Ŝt(n) indicates a synthesized audio signal of the current frame.

This long term synthesis process is similar to the process performed by the long term synthesis unit 130 of the long term encoding device previously described with reference to FIG. 1; however, the long term synthesis unit 130 of the long term encoding device performs long term synthesis based on long term prediction information (candidate prediction gain and candidate pitch lag), whereas the long term synthesis unit 330 of the long term decoding device performs long term synthesis with respect to the final prediction gain and the final pitch lag transmitted through the bit stream. As previously described, the final pitch lag do results from searching of a signal the most similar to the current frame in frames including the preceding frame in addition to the (t−1)-th frame, with the result that a final pitch lag range starts with 0, not N (frame length). If the final pitch lag range starts with N, only the remaining values excluding N can be transmitted. On the other hand, if the final pitch lag range starts with 0, all of the values can be transmitted. When the final pitch lag value is transmitted without subtraction of a specific value from the final pitch lag value, other values (for example, N) excluding the final pitch lag d0 are not applied to the long term synthesis process defined as represented by Mathematical expression 6.

The long term decoding device restores an audio signal of the current frame using the long term prediction information and the audio signal of the preceding frame through the above process.

Figure 9:
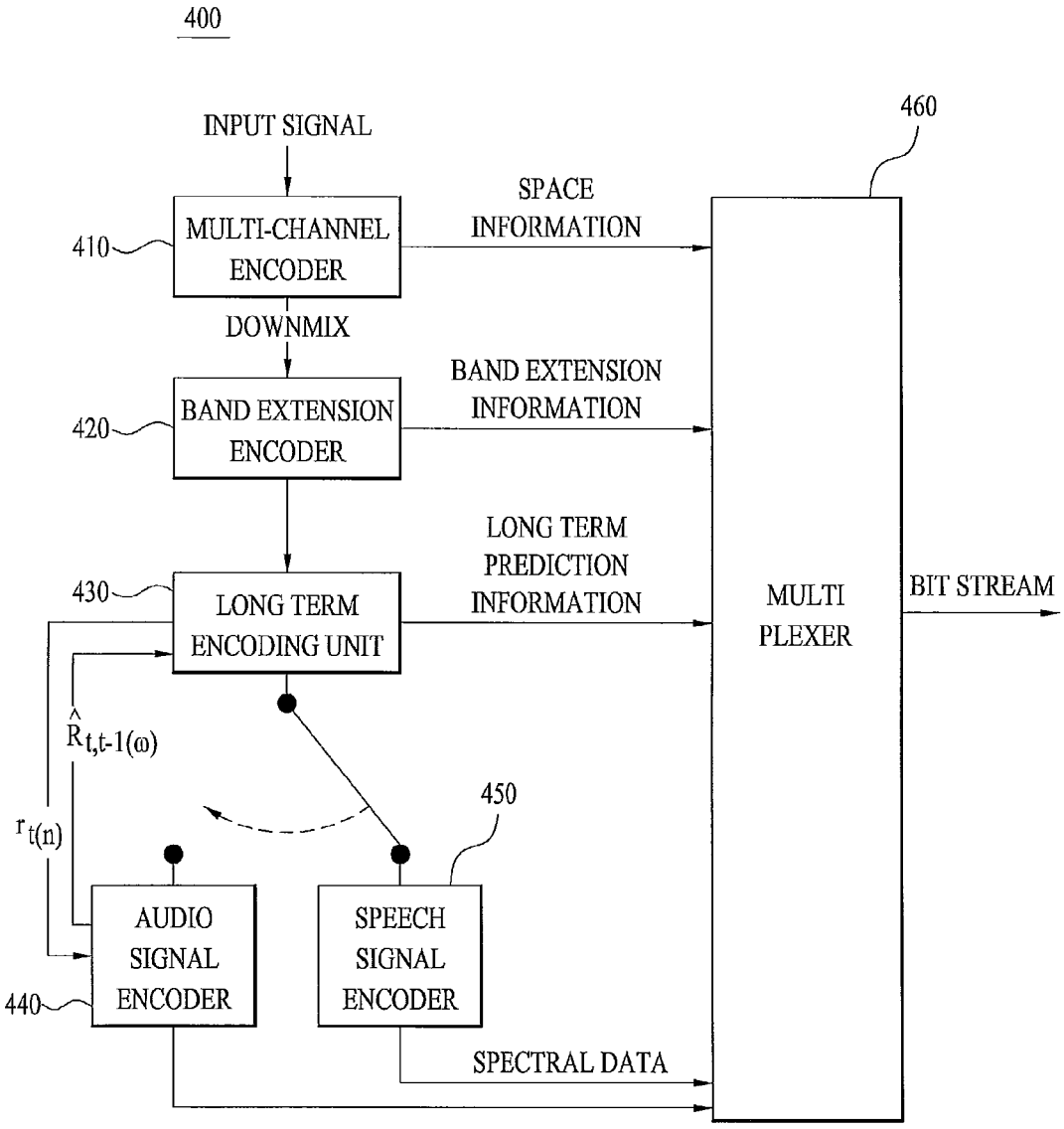
FIG. 9 is a construction view illustrating a first example (an encoding device) of the audio signal processing apparatus according to the embodiment of the present invention.

FIG. 9 is a construction view illustrating a first example (an encoding device) of the audio signal processing apparatus according to the embodiment of the present invention. Referring to FIG. 9, an audio signal encoding device 400 includes a multi-channel encoder 410, a band extension encoder 420, an audio signal encoder 440, a speech signal encoder 450, and a multiplexer 460. Of course, the audio signal encoding device 400 may further include a long term encoding unit 430 according to an embodiment of the present invention.

The multi-channel encoder 410 receives a plurality of channel signals (two or more channel signals) (hereinafter, referred to as a multi-channel signal), performs downmixing to generate a mono downmixed signal or a stereo downmixed signal, and generates space information necessary to upmix the downmixed signal into a multi-channel signal. Here, space information may include channel level difference information, inter-channel correlation information, a channel prediction coefficient, downmix gain information, and the like. If the audio signal encoding device 400 receives a mono signal, the multi-channel encoder 410 may bypass the mono signal without downmixing the mono signal.

The band extension encoder 420 may generate band extension information to restore data of a downmixed signal excluding spectral data of a partial band (for example, a high frequency band) of the downmixed signal.

The long term encoding unit 430 performs long term prediction with respect to an input signal to generate long term prediction information b0 and d0. Meanwhile, the component 200 (the frequency transforming unit 210, the quantization unit 220, and the psychoacoustic model 230) previously described with reference to FIG. 1 may be included in the audio signal encoder 440 and the speech signal encoder 450, which will be described hereinafter. Consequently, the long term encoding unit 430 excluding the component 200 transmits a temporary residual rt(n) to the audio signal encoder 440 and the speech signal encoder 450 and receives a frequency transformed residual $\hat{R}t,t-1(\omega)$.

The audio signal encoder 440 encodes a downmixed signal using an audio coding scheme when a specific frame or segment of the downmixed signal has a high audio property. Here, the audio coding scheme may be based on an advanced audio coding (AAC) standard or a high efficiency advanced audio coding (HE-AAC) standard, to which, however, the present invention is not limited. Meanwhile, the audio signal encoder 440 may be a modified discrete transform (MDCT) encoder.

Meanwhile, the audio signal encoder 440 may include the frequency transforming unit 210, the quantization unit 220, and the psychoacoustic model 230 previously described with reference to FIG. 1. Consequently, the audio signal encoder 440 receives a temporary residual rt(n) from the long term encoding unit 430, generates a frequency transformed residual $\hat{R}t,t-1(\omega)$, and transmits the frequency transformed residual $\hat{R}t,t-1(\omega)$ to the long term encoding unit 430. Here, spectral data and a scale factor obtained through quantization of the frequency transformed residual $\hat{R}t,t-1(\omega)$ may be transmitted to the multiplexer 460.

The speech signal encoder 450 encodes a downmixed signal using a speech coding scheme when a specific frame or segment of the downmixed signal has a high speech property. Here, the speech coding scheme may be based on an adaptive multi-rate wide band (AMR-WB) standard, to which, however, the present invention is not limited. Meanwhile, the speech signal encoder 450 may also use a linear prediction coding (LPC) scheme. When a harmonic signal has high redundancy on the time axis, the harmonic signal may be modeled through linear prediction which predicts a current signal from a previous signal. In this case, the LPC scheme may be adopted to improve coding efficiency. Meanwhile, the speech signal encoder 450 may be a time domain encoder.

The multiplexer 460 multiplexes space information, band extension information, long term prediction information, and spectral data to generate an audio signal bit stream.

Figure 10:
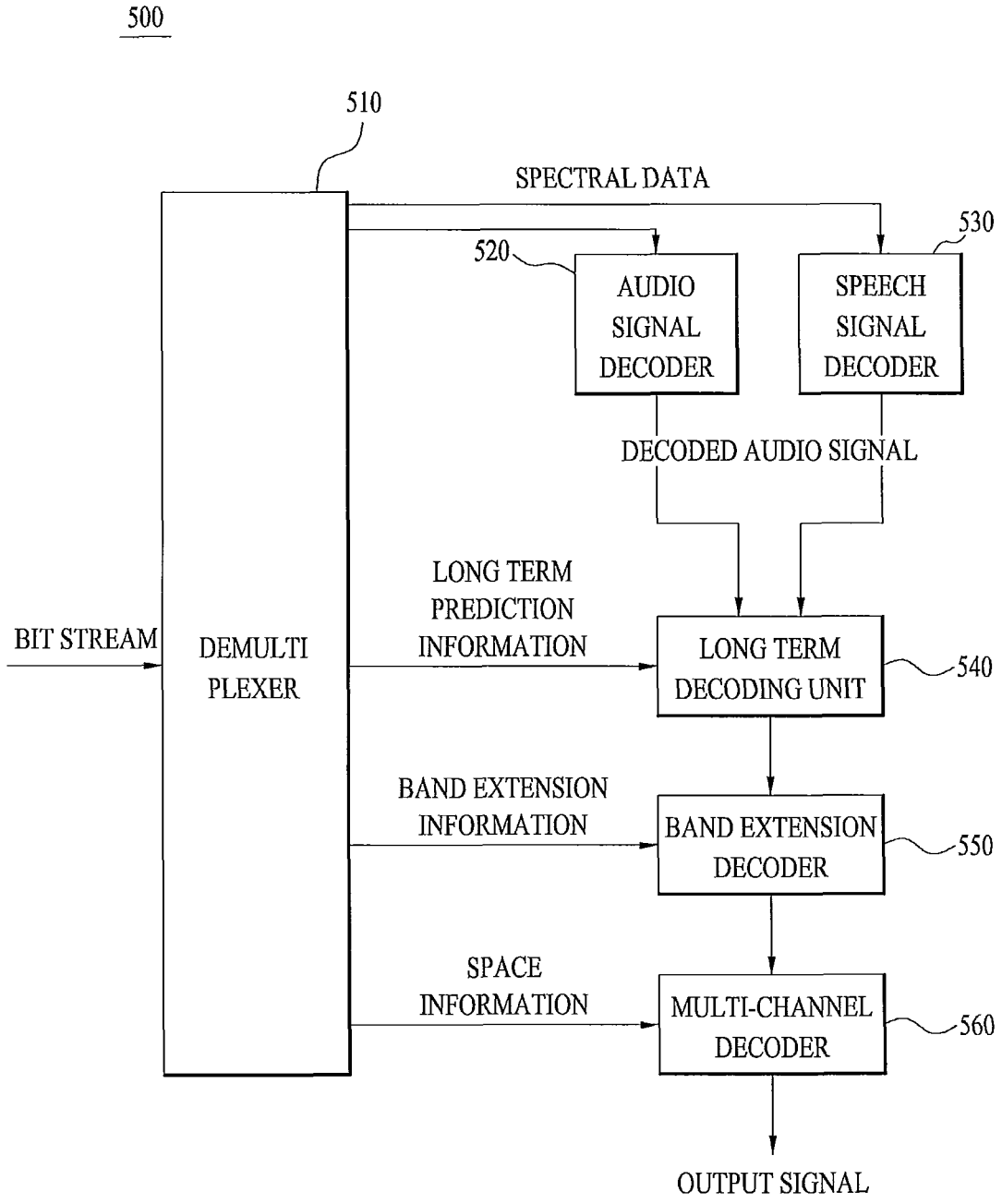
FIG. 10 is a construction view illustrating a second example (a decoding device) of the audio signal processing apparatus according to the embodiment of the present invention.

FIG. 10 is a construction view illustrating a second example (a decoding device) of the audio signal processing apparatus according to the embodiment of the present invention. Referring to FIG. 10, an audio signal decoding device 500 includes a demultiplexer 510, an audio signal decoder 520, a speech signal decoder 530, a band extension decoder 550, and a multi-channel decoder 560. Also, the audio signal decoding device 500 further includes a long term decoding unit 540 according to an embodiment of the present invention is further included.

The demultiplexer 510 multiplexes spectral data, band extension information, long term prediction information, and space information from an audio signal bit stream.

The audio signal decoder 520 decodes spectral data corresponding to a downmixed signal using an audio coding scheme when the spectral data has a high audio property. Here, the audio coding scheme may be based on an AAC standard or an HE-AAC standard, as previously described. Meanwhile, the audio signal decoder 520 may include the de-quantization unit 310 and the inverse transforming unit 320 previously described with reference to FIG. 7. Consequently, the audio signal decoder 520 de-quantizes the spectral data and the scale factor transmitted through the bit stream to restore a frequency transformed residual. Subsequently, the audio signal decoder 520 performs inverse frequency transforming with respect to the frequency transformed residual to generate an (inversely transformed) residual.

The speech signal decoder 530 decodes a downmixed signal using a speech coding scheme when the spectral data has a high speech property. Here, the speech coding scheme may be based on an AMR-WB standard, as previously described, to which, however, the present invention is not limited.

The long term decoding unit 540 performs long term synthesis using the long term prediction information and the (inversely transformed) residual signal to restore a synthesized audio signal. The long term decoding unit 540 may include the long term synthesis unit 330 previously described with reference to FIG. 7.

The band extension decoder 550 decodes a bit stream of band extension information and generates an audio signal (or spectral data) of a different band (for example, a high frequency band) from some or all of the audio signal (or the spectral data) using this information.

When the decoded audio signal is downmixed, the multi-channel decoder 560 generates an output channel signal of a multi-channel signal (including a stereo channel signal) using space information.

The long term encoding device or the long term decoding device according to the present invention may be included in a variety of products, which may be divided into a standalone group and a portable group. The standalone group may include televisions (TV), monitors, and settop boxes, and the portable group may include portable media players (PMP), mobile phones, and navigation devices.

Figure 11:
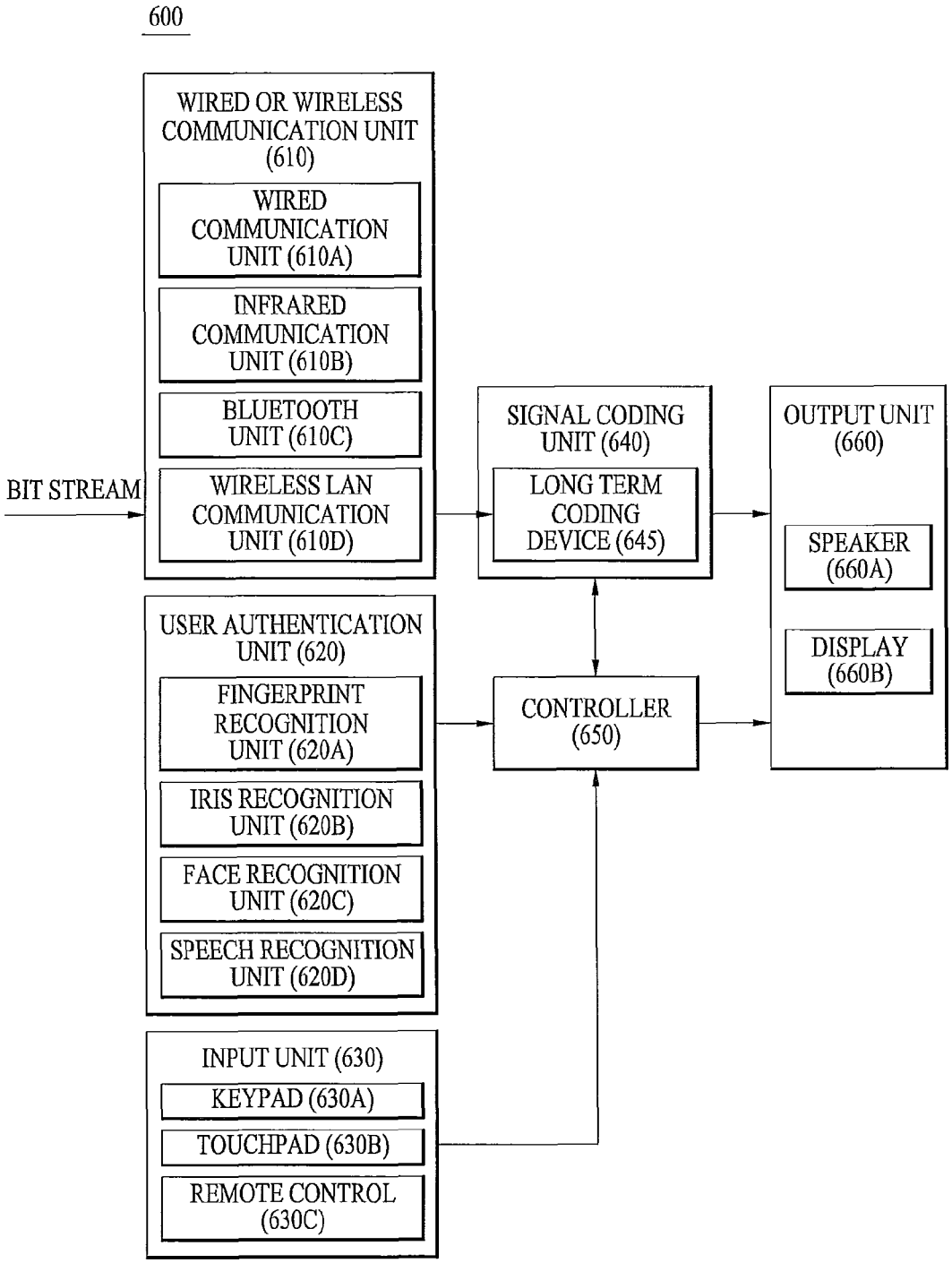
FIG. 11 is a schematic construction view illustrating a product to which the long term coding (encoding and/or decoding) device according to the embodiment of the present invention is applied.
Figure 12:
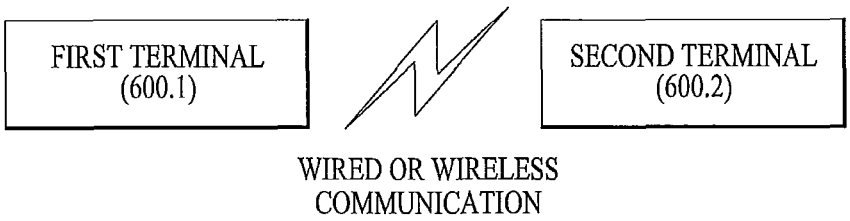
FIG. 12 is a view illustrating a relationship between products to which the long term coding (encoding and/or decoding) device according to the embodiment of the present invention is applied.
Figure 12:
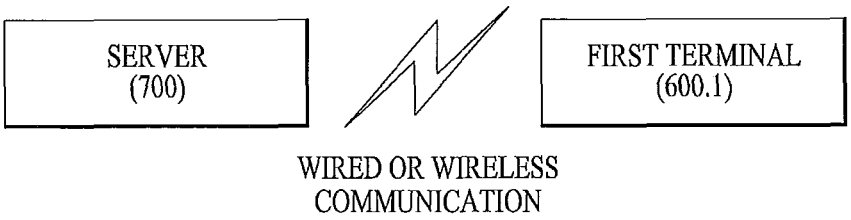

FIG. 11 is a schematic construction view illustrating a product to which the long term coding (encoding and/or decoding) device according to the embodiment of the present invention is applied. FIG. 12 is a view illustrating a relationship between products to which the long term coding (encoding and/or decoding) device according to the embodiment of the present invention is applied.

Referring first to FIG. 11, a wired or wireless communication unit 610 receives a bit stream using a wired or wireless communication scheme. Specifically, the wired or wireless communication unit 610 may include at least one selected from a group consisting of a wired communication unit 610A, an infrared communication unit 610B, a Bluetooth unit 610C, and a wireless LAN communication unit 610D.

A user authentication unit 620 receives user information to authenticate a user. The user authentication unit 620 may include at least one selected from a group consisting of a fingerprint recognition unit 620A, an iris recognition unit 620B, a face recognition unit 620C, and a speech recognition unit 620D. The fingerprint recognition unit 620A, the iris recognition unit 620B, the face recognition unit 620C, and the speech recognition unit 620D receive fingerprint information, iris information, face profile information, and speech information, respectively, convert the received information into user information, and determine whether the user information coincides with registered user data to authenticate the user.

An input unit 630 allows a user to input various kinds of commands. The input unit 630 may include at least one selected from a group consisting of a keypad 630A, a touchpad 630B, and a remote control 630C, to which, however, the present invention is not limited. A signal coding unit 640 includes a long term coding device (a long term encoding device and/or a long term decoding device) 645. The long term encoding device 645 includes at least the long term prediction unit, the inverse transforming unit, the long term synthesis unit, and the prediction information decision unit of the long term encoding device previously described with reference to FIG. 1. The long term encoding device 645 performs long term prediction with respect to a source audio signal to generate a temporary prediction gain and a temporary pitch lag and performs long term synthesis and prediction information decision to generate a final prediction gain and a final pitch lag. On the other hand, the long term decoding device (not shown) includes at least the long term synthesis unit of the long term decoding device previously described with reference to FIG. 7. The long term decoding device performs long term synthesis based on the long term residual and the final long term prediction information to generate a synthesized audio signal.

The signal coding unit 640 encodes an input signal through quantization to generate a bit stream or decodes the signal using the received bit stream and spectral data to generate an output signal.

A controller 650 receives input signals from input devices and controls all processes of the signal coding unit 640 and an output unit 660. The output unit 660 outputs an output signal generated by the signal coding unit 640. The output unit 660 may include a speaker 660A and a display 660B. When an output signal is an audio signal, the output signal is output to the speaker. When an output signal is a video signal, the output signal is output to the display.

FIG. 12 shows a relationship between terminals each corresponding to the product shown in FIG. 11 and between a server and a terminal corresponding to the product shown in FIG. 11. Referring to FIG. 12(A), a first terminal 600.1 and a second terminal 600.2 bidirectionally communicate data or a bit stream through the respective wired or wireless communication units thereof. Referring to FIG. 12(B), a server 700 and a first terminal 600.1 may communicate with each other in a wired or wireless communication manner.

The audio signal processing method according to the present invention may be modified as a program which can be executed by a computer. The program may be stored in a recording medium which can be read by the computer. Also, multimedia data having a data structure according to the present invention may be stored in a recording medium which can be read by the computer. The recording medium which can be read by the computer includes all kinds of devices that store data which can be read by the computer. Examples of the recoding medium which can be read by the computer may include a read only memory (ROM), a random access memory (RAM), a compact disc ROM (CD-ROM), a magnetic tape, a floppy disc, and an optical data storage device. In addition, a recoding medium employing a carrier wave (for example, transmission over the Internet) format may be further included. Also, a bit stream generated by the encoding method as described above may be stored in a recording medium which can be read by a computer or may be transmitted using a wired or wireless communication network.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The present invention is applicable to encoding and decoding of an audio signal.

What is claimed is:

1. An audio signal processing method comprising:

performing long term prediction on a time domain using a source audio signal of a preceding frame to generate a temporary prediction gain, a temporary pitch lag, and a temporary residual of a current frame;

frequency transforming the temporary residual using the preceding frame and the current frame;

inversely frequency transforming the frequency transformed temporary residual to generate a synthesized residual of the preceding frame;

performing, in a mobile terminal, long term synthesis using the temporary prediction gain, the temporary pitch lag, and the synthesized residual of the preceding frame to generate a synthesized audio signal of the preceding frame;

deciding long term prediction information using the synthesized audio signal of the preceding frame, the long term prediction information including a final prediction gain and a final pitch lag; and generating a bitstream including the final prediction gain, the final pitch lag and the frequency transformed temporary residual, wherein the synthesized residual of the preceding frame is generated by inverse transforming two consecutive and partially overlapping current and preceding frames and then adding the inverse transformed two frames.

2. The audio signal processing method according to claim 1, wherein the long term synthesis is performed using one or more candidate prediction gains based on the temporary prediction gain and one or more candidate pitch lags based on the temporary pitch lag.

3. The audio signal processing method according to claim 1, wherein the long term prediction information is decided based on the source audio signal.

4. An audio signal processing apparatus comprising:

a long term prediction unit configured to perform long term prediction on a time domain using a source audio signal of a preceding frame to generate a temporary residual of a current frame;

a frequency transforming unit configured to frequency transform the temporary residual using the preceding frame and the current frame;

an inverse transforming unit configured to inversely frequency transform the frequency transformed temporary residual to generate a synthesized residual of the preceding frame;

a long term synthesis unit configured to perform long term synthesis using the temporary prediction gain, the temporary pitch lag, and the synthesized residual of the preceding frame to generate a synthesized audio signal of the preceding frame; and a prediction information decision unit configured to decide long term prediction information using the synthesized audio signal of the preceding frame, the long term prediction information including a final prediction gain and a final pitch lag, wherein the final prediction gain, the final pitch lag and the frequency transformed temporary residual are included in a bitstream, and wherein the synthesized residual of the preceding frame is generated by inverse transforming two consecutive and partially overlapping current and preceding frames and then adding the inverse transformed two frames.

5. The audio signal processing apparatus according to according to claim 4, wherein the long term synthesis is performed using one or more candidate prediction gains based on the temporary prediction gain and one or more candidate pitch lags based on the temporary pitch lag.

6. The audio signal processing apparatus according to claim 4, wherein the long term prediction information is decided based on the source audio signal.

7. A non-transitory computer-readable storage medium for storing instructions that, when executed by a computer, perform the steps of:

performing long term prediction on a time domain using a source audio signal of a preceding frame to generate a temporary prediction gain, a temporary pitch lag, and a temporary residual of a current frame;

frequency transforming the temporary residual using the preceding frame and the current frame;

inversely frequency transforming the frequency transformed temporary residual to generate a synthesized residual of the preceding frame;

performing, in a mobile terminal, long term synthesis using the temporary prediction gain, the temporary pitch lag, and the synthesized residual of the preceding frame to generate a synthesized audio signal of the preceding frame;

deciding long term prediction information using the synthesized audio signal of the preceding frame, the long term prediction information including a final prediction gain and a final pitch lag; and generating a bitstream including the final prediction gain, the final pitch lag and the frequency transformed temporary residual, wherein the synthesized residual of the preceding frame is generated by inverse transforming two consecutive and partially overlapping current and preceding frames and then adding the inverse transformed two frames.

* * * * *